US005722663A

United States Patent [19]

Avigal et al.

[11] Patent Number: 5,722,663

[45] Date of Patent: Mar. 3, 1998

[54] MAGNETIC CARD PICK-UP GAME AND APPARATUS

[76] Inventors: Shlomi Avigal, 92 Ibn Gvirol, Tel Aviv; Yakov Kedmi, 14 Mishol Shoham, Holon; Nir Manor, 27 Averbuch, Ramat Hasharon; Avraham Pirchi, 23 Rahel, Kfar Saba, all of Israel

[21] Appl. No.: 677,670

[22] Filed: Jul. 8, 1996

[51] Int. Cl.[6] ..... A63B 67/10

[52] U.S. Cl. ..... 273/448; 273/348.3

[58] Field of Search ..... 273/448, 344, 273/345, 346, 347, 140, 239, 348.3; 434/330, 339, 340

[56] References Cited

U.S. PATENT DOCUMENTS

| | | | |
|---|---|---|---|
| 1,991,626 | 2/1935 | Rawdon | 273/448 |
| 2,997,793 | 8/1961 | Kelly | 434/339 |
| 3,118,669 | 1/1964 | Merrill | 273/345 |
| 3,249,357 | 5/1966 | Luchsinger | 273/448 |
| 3,830,498 | 8/1974 | Lauzon | 273/345 |
| 4,305,587 | 12/1981 | O'Grady | 273/345 |
| 4,326,709 | 4/1982 | Croyle | 273/448 |
| 5,005,841 | 4/1991 | Klick | 273/345 |

*Primary Examiner*—William H. Grieb
*Attorney, Agent, or Firm*—Mark M. Friedman

[57] ABSTRACT

A game apparatus which includes a magnet tied to an elastic cable and a number of cards which are attractive to the magnet. To play the game, the player holds the elastic cable and throws the magnet so as to cause the magnet to impact one or more of the cards so as to magnetically attract and retrieve at least one of them.

8 Claims, 2 Drawing Sheets

MAGNETIC CARD PICK-UP GAME AND APPARATUS

FIELD AND BACKGROUND OF THE INVENTION

The present invention relates to games and game apparatus, and, more particularly, to games and associated apparatus for picking up cards from a surface with the help of a device without the direct use of the hands.

Various games are available wherein the user is required to pick up one or more objects lying on a surface without directly using his or her hands. For example, in typical 'fishing' games the player uses a rod at the end of which is suspended a line which ends in a hook. A number of objects having a suitable hoop or ring are arranged on a surface. The player is required to slowly move the rod so as to cause the hook to engage the hoop or ring and then to pick up one of the items. The game tests the hand-eye coordination and the patience of the player. A shortcoming of fishing games is that the act of fishing items is relatively slow and not conducive to play by a group of players.

Various games are available wherein the player is required to throw an item at a target. The game of darts is typical. Here, the player is required to throw a dart at a target, typically hanging on the wall, and to cause the dart to hit as near as possible to the very center of the target. A shortcoming of dart games is that the dart ends up on a faraway board and needs to be retrieved.

Still other games involve the throwing of an item which remains somehow attached to the player's hand and, as a result, returns to the user. A classic example of this is a yo-yo. A shortcoming of yo-yo's is that they are not conducive to competitive or multi-player games.

It would be highly advantageous to have a game suitable for fast multi-person competition and associated apparatus wherein the player is called upon to accurately throw a device at a target object so as to retrieve the target object.

SUMMARY OF THE INVENTION

According to the present invention there is provided a game apparatus, comprising: (a) a magnet; (b) an elastic cable connected near one of its end to the magnet; and (c) a plurality of cards attractive to the magnet.

Also according to the present invention, there is provided a game comprising the steps of: (a) providing a game apparatus which includes: (i) a magnet; (ii) an elastic cable connected near one of its end to the magnet; and (iii) a plurality of cards attractive to the magnet; and (b) while holding only the elastic cable, causing the magnet to proximally approach at least one of the plurality of cards so as to magnetically attract and retrieve at least one of the cards.

According to further features in preferred embodiments of the invention described below, the cards include a metallic paint, preferably interposed between two portions of the card.

According to still further features in the described preferred embodiments, the game further includes catching the magnet with the retrieved card.

The present invention successfully addresses the shortcomings of presently known games and game apparatus by providing a game and apparatus which makes it possible to throw a device with the aim of magnetically attracting and retrieving a certain object.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a magnetic card pick-up game and apparatus which can be used to pick up cards as part of a competitive or solitary game.

The principles and operation of a game and game apparatus according to the present invention may be better understood with reference to the drawings and the accompanying description.

Figure 1:
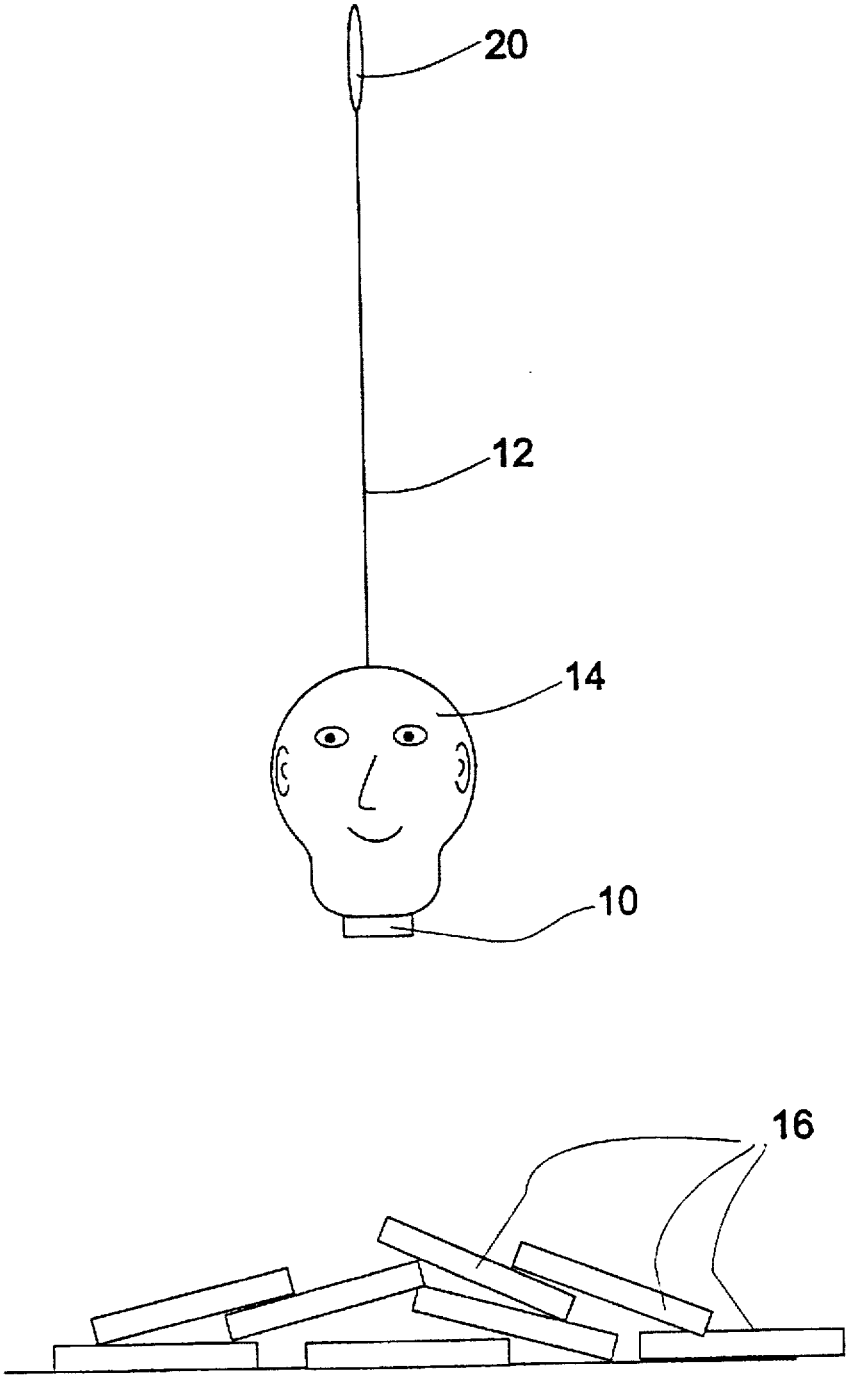
FIG. 1 is an overall depiction of a magnetic card pick-up game and apparatus according to the present invention.

Referring now to the drawings, FIG. 1 illustrates the overall concept. The game apparatus includes a magnet 10 which is directly or indirectly connected near one end of an elastic cable 12. Magnet 10 may be any suitable permanent magnet of proper dimensions and strength. Elastic cable 12 may be any cable, wire, line, thread, rope, band, and the like, (any and all of which are, for convenience, termed 'cable' in the specification and claims) provided that it has the ability to support magnet 10 and to stretch to a significant extent and return to its former length. The elasticity of elastic cable 12 should allow it to increase in length to at least 110% of its unstressed length, preferably it should be able to stretch to at least 150% of its unstressed length.

Preferably, magnet 10 is not connected directly to elastic cable 12 but is rather mounted in a body, most preferably, a FIG. 14, which is, in turn, connected to elastic cable 12, as shown in FIG. 1. Most preferably, FIG. 14 is in the form of a face. FIG. 14 serves at least two functions. First, it provides suitable weight so that ensemble of FIG. 14 and magnet 10 have the proper total weight for suitable play action. Second, the appearance of FIG. 14 adds aesthetic value to the game apparatus, for example, allowing the player to envision that it is the figure which is picking up the cards, as described below.

Figure 2:
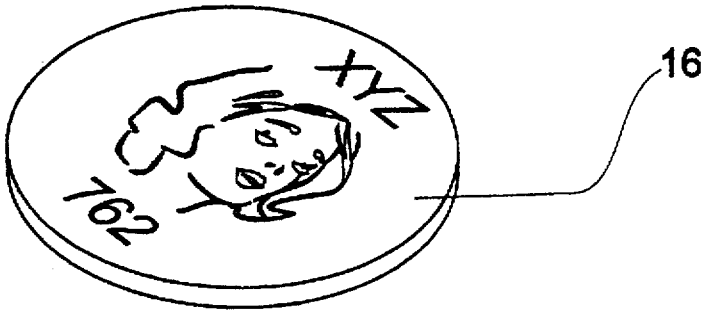
FIG. 2 shows an illustrative card according to the present invention.
Figure 2:
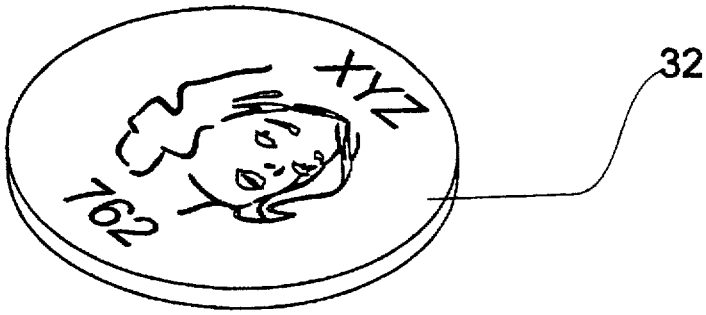

The game apparatus further includes a number of cards 16 which are attractive to magnet 10 and which, under certain circumstances, can be picked up by magnet 10. Cards 16 may be of virtually any shape and may have virtually any printing or marking on one or both of their faces (FIG. 2). Preferably, cards 16 are substantially flat so that, when placed or thrown on a reasonably flat surface, such as a floor 18, they lie substantially horizontal, albeit with some deviation whenever cards 16 pile on top of one another, as shown in cross-section in FIG. 1.

Elastic cable 12 is preferably of sufficient length that a player standing up is able to throw magnet 10 (with attendant FIG. 14, if any) downward so as to cause magnet 10, after suitable stretching of elastic cable 12, to impact, or come very near, cards 16 lying on floor 18. Preferably, elastic cable 12 features a loop 20 near its top end which can be fitted around one or more of the player's fingers prior to use. For shorter players, or for play when the surface on which cards 18 are arrayed is higher than the floor, the player may wrap a suitable portion of elastic cable 12 around his finger or fingers so as to effectively shorten elastic cable 12 to the proper length.

Figure 3:
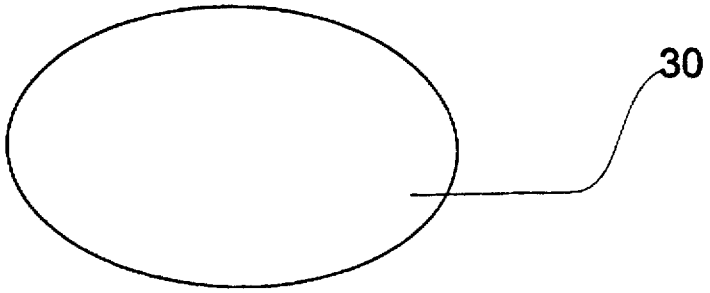
FIG. 3 is an exploded view of several possible configuration of the card of FIG. 2.
Figure 3:
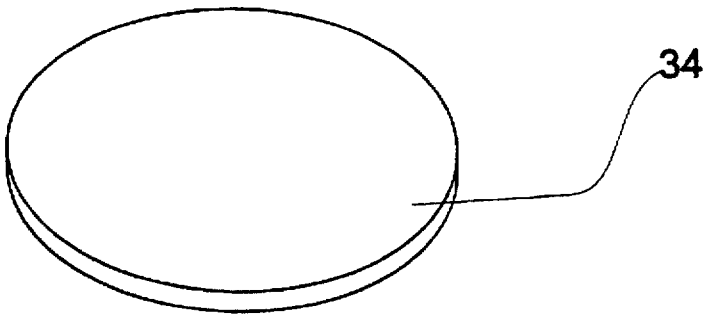

Cards 16 are rendered attractive to magnet 10 through the inclusion in cards 16 of a metal, such as iron, for example, which is attracted to magnets. The metal in question can be included in cards 16 through a variety of means. For example, cards 16 may include a metallic layer 30 (FIG. 3), preferably interposed between an upper portion 32 and a lower portion 34 of card 16, possibly held together with a suitable adhesive (not shown). Metallic layer 30 may be in the form of a solid layer, such as a foil, or in the form of a mesh of appropriate design.

Preferably, cards 16 include metal which is attractive to magnet 10 which is dispersed in a paint. The metallic paint can be used to paint one or both outside faces of card 16 (e.g., FIG. 2) or, preferably, metallic paint (depicted schematically as 30 in FIG. 3) can be painted on one or both of upper portion 32 and lower portion 34 of card 16 and the two portions are combined, with or without the use of a suitable adhesive (not shown) to form the complete card 16 (FIG. 2).

To play a game using the apparatus of the present invention, the player holds on to one end of elastic cable 12, preferably by inserting one or more of his or her fingers through loop 20. A number of cards 16 are placed or thrown onto a surface, such as floor 18. The player now aims and releases and/or throws magnet 10 (or the combined structure including magnet 10 and FIG. 14) downward toward cards 16. The player attempts to avoid giving magnet 10 insufficient force to reach cards 16 but not too much force which will result in too large an impact of magnet 10 with one or more card 16. The aim is to give magnet 10 just enough force to closely approach or lightly impact (referred to hereinafter as "proximally approach") card 16 so as to maximize the time the magnet 10 is in close proximity of card 16 which will maximize the chance of picking up, or retrieving, card 16 with magnet 10.

Various rules may be applied for solitary and competitive group play. For example, it may be a requirement to catch magnet 10 and the retrieved card 16 as they come up after a successful retrieval.

For group play, it may be desirable for each player to throw in a number of cards. The player then take turns attempting to retrieve the cards, as described above. The cards may have different point value depending on their size, shape, markings, and the like. One or more unsuccessful attempts at retrieval may obligate the player to throw in another card. Successfully retrieving a certain card may provide the player with another turn. Many other rules and game configurations may be envisioned using the basic game apparatus of the present invention.

While the invention has been described with respect to a limited number of embodiments, it will be appreciated that many variations, modifications and other applications of the invention may be made.

What is claimed is:

1. A game apparatus, comprising:

(a) a magnet;

(b) an elastic cable connected near one end to said magnet; and (c) a plurality of cards attractive to said magnet, each of said cards including a metallic mesh layer.

2. The game apparatus of claim 1, wherein said magnet is connected to a figure, said figure being connected to said elastic cable.

3. The game apparatus of claim 2, wherein said figure is a face.

4. The game apparatus of claim 1, wherein said elastic cable features a loop near an opposite end.

5. A game comprising the steps of:

(a) providing a game apparatus which includes:

(i) a magnet;

(ii) an elastic cable connected near one of its end to said magnet; and (iii) a plurality of cards attractive to said magnet, each of said cards featuring a metallic mesh layer; and (b) while holding only said elastic cable, causing said magnet to proximally approach at least one of said plurality of cards so as to maximize the time said magnet is in close proximity to said at least one of said plurality of cards for magnetically attracting and retrieving at least one of said cards.

6. The game of claim 5, further comprising:

(c) catching said magnet with said retrieved card.

7. The game of claim 5, wherein said magnet is connected to a figure, said figure being connected to said elastic cable.

8. The game of claim 5, wherein said elastic cable features a loop near an opposing end and wherein said holding of said elastic cable is effected by inserting a finger through said loop.

* * * * *